US006630780B1

(12) United States Patent
Yan

(10) Patent No.: US 6,630,780 B1
(45) Date of Patent: Oct. 7, 2003

(54) DUAL CIRCULAR FLUORESCENT LAMP

(75) Inventor: Ellis Yan, Russell, OH (US)

(73) Assignee: Technical Consumer Products, Inc., Aurora, OH (US)

( * ) Notice: Subject to any disclaimer, the term of this patent is extended or adjusted under 35 U.S.C. 154(b) by 238 days.

(21) Appl. No.: 09/955,009

(22) Filed: Sep. 19, 2001

(51) Int. Cl.[7] ..... H01J 1/62
(52) U.S. Cl. ..... 313/493; 313/634
(58) Field of Search ..... 313/493, 634

(56) References Cited

U.S. PATENT DOCUMENTS 2,309,676 A 2/1943 Schmidling
2,446,712 A 8/1948 McIlvaine
5,034,655 A 7/1991 Murayama et al.
5,723,939 A * 3/1998 Okuno et al. ..... 313/493

* cited by examiner

*Primary Examiner*—Vip Patel
(74) *Attorney, Agent, or Firm*—Joseph H. Taddeo

(57) ABSTRACT

An improved dual circular fluorescent lamp having two or more lamp segments nested in an annular fashion to increase the lumen output. Each annulus is arranged concentrically where each annulus resides in an individual plane that is parallel to previous plane containing another annulus. Each annulus may be made from glass tubing where each annulus is comprised of a different diameter to maintain an equal volume for each annulus. In the preferred embodiment the circular rings coaxially non-coplanar and are arranged in a conical pyramid for typical use as a table or desk lamp, a pendant or ceiling mounted lighting fixture or a torchere floor lamp.

20 Claims, 6 Drawing Sheets

DUAL CIRCULAR FLUORESCENT LAMP

FIELD OF INVENTION

The present invention relates primarily to a fluorescent lamp and more particularly to a circular annularly nested fluorescent lamp having a tubular bridged connection with effectively increases the tube length to provide a high lumen output.

BACKGROUND OF THE INVENTION

Today, there are many styles of fluorescent lamp tubes, some of which are the conventional longitudinal tubes, others in the form of compact U-tubes and still others, circular. To effectively increase the lumen output when used in a typical fluorescent lighting plurality of lamps are used.

In the case of the circular lamp, it can be configured using a plurality of circular lamps, arranged of different diameters so that they are coaxially circular in the same radial plane. This configuration, however, has the disadvantage that when individual lamps are used, the lighting fixture becomes unnecessarily large and more expensive due to the fact that for each individual concentrically nested lamp, there is a pair of electrodes at each end, each pair requiring a ballasting arrangement.

To overcome this disadvantage, a pair of nested concentric lamps, lying in one and the same plane, can be connected using a hollow tubular bridge to increase the effective tube length, where only a single pair of electrodes is used, one at each end, and where only one ballasting arrangement is used.

When two lamps of the same cross sectional diameter are connected by a hollow tubular bridge to effectively increase the lamp discharge path for increased lumen output, with continued operation over time, the innermost annular concentric tube, becomes more difficult to ignite, requiring a higher ignition voltage.

Examples of such prior art are shown in the examples that follow.

U.S. Pat. No. 5,034,655, granted Jul. 23, 1991, to S. Murayama, et al., discloses a fluorescent lamp having a pair of electrodes, at least two circular discharge tubes connected to said electrodes, containing a rare gas and mercury and having a phosphor coating on the inside wall. The tubes are arranged coaxially circular in the same radial plane.

U.S. Pat. No. 2,446,712, granted Aug. 10, 1948, to H. A. McIlvaine, discloses a fluorescent lamp having double spiral grooves in a glass body, containing a gaseous vapor, the grooves being sealed with a glass cover plate, and having electrodes at the sealed ands of the grooves. The electrodes are configured at each sealed end in two configurations, both inwardly and outwardly.

U.S. Pat. No. 2,309,676, granted Feb. 2, 1943, to G. T. Schmidling, discloses a fluorescent lamp fixture having a circular fluorescent lamp mounted within a bell shaped reflector and housing. Further disclosed is a fluorescent lamp having an improved coating that reproduces the color quality equivalent to the sky-shine plus noon sunlight.

All of the above referenced prior art disclose circular fluorescent lamps, ones that are coaxially circular, or spiraled radially, where all the tubes reside coplanar.

What is needed are concentrically nested, circular fluorescent lamps that are tubularly bridged and can be arranged for use in uplighted torchere styled lighting fixtures as well as table lamps and pendant types of downlighted fixtures, where each concentric lamp of different diameters, lying in different planes, having each plane parallel to each other, either above or below the other; a lamp that can be started at a lower voltage for operation on a nominal 117 AC volts.

It is therefore an object of the present invention to provide for a circular fluorescent lamp, having a plurality of nested concentric tubes, each connected to each other using a hollow tubular bridge, to increase the discharge path length, for increased lumen output.

It is another object of the present invention to provide for a circular fluorescent lamp, having a plurality of nested concentric tubes, where each concentric lamp of different diameter lying in different planes, each plane being parallel to each other, either above or below the other.

It is still another object of the present invention to provide for a circular fluorescent lamp, having a plurality of nested concentric tubes, where the tube diameter for each concentric lamp differs and is adjusted to have an equal volume for the entrapped gas for each concentric ring section.

It is still yet another object of the present invention to provide for a circular fluorescent lamp, having a plurality of nested concentric tubes, where the tube diameter for each concentric lamp differs and is adjusted to have an equal volume for the entrapped gas for each concentric ring section that will have a lower starting voltage that is compatible for use in 117 VAC applications.

Yet, it is another object of the present invention to provide for a circular fluorescent lamp, having a plurality of nested concentric tubes, where each circular ring does not lie in the same plane, that are arranged for use in an uplighted torchere floor lamp.

Yet still, it is a another object of the present invention to provide for a circular fluorescent lamp, having a plurality of nested concentric tubes, where each circular ring does in the same plane, that are arranged for use in a downlighted ceiling mounted lighting fixture.

It is a final object of the present invention to provide for a circular fluorescent lamp, having a plurality of nested concentric tubes, where each circular ring does not lie in the same plane, that are arranged for use in a downlighted table or desk lamp.

These as well as other objects and advantages of the present invention will be better understood and appreciated upon reading the following detailed description of the preferred embodiment when taken in conjunction with the accompanying drawings.

SUMMARY OF THE INVENTION

The present invention relates primarily to circular fluorescent lamps, and in general, to a plurality of circular lamps that are concentrically nested to increase the available lumen output. By coupling together two circular fluorescent lamps, an inner and an outer circular fluorescent lamp, using a hollow glass tubular bridge, a dual circular fluorescent lamp having an increased discharge path is created.

If each lamp section, both the inner and outer section have the same cross sectional area by using the same diameter tubing during the manufacturing process, the finished product performance deteriorates over a period of time. With the passage of time over its useful period, the innermost lamp becomes more difficult to ignite, generally requiring an increased ignition voltage and if none is available, the useful life of the lamp ends, thereby necessitating replacement.

To overcome this objectionable performance, the prior art requires that the lamps, both circular as well as spiral, have tubes that reside coplanarly. This requirement is due to the fact that the entrained inert gas and mercury vapor migrate toward the larger diameter circular tube. The volume of the outer larger diameter ring is greater than the inner smaller diameter ring and when the arc is formed within the tubes, the temperature of the gas and vapor increases. According to Boyle's Law, the pressure is greater in the innermost circular tube than it is in the outermost tube because of the difference in the volumes of the two circular tubes, when operating at a constant temperature. When the lamps are turned off and as the lamps cool, the mercury vapor migrates toward the outer tube having the lower pressure, where it condenses, leaving less vapor in the inner circular tube, making it more difficult to restart.

In the first aspect of the present invention, to keep the pressure gradient across the hollow tubular bridge at zero, the cross sectional diameter of the innermost ring is increased so that the volume of each circular ring is equal, thereby maintaining a constant pressure in both the inner and outer ring.

In a second aspect of the present invention, by increasing the cross sectional diameter of the innermost tube and by allowing it to be in a plane lower than the plane of the outer tube, it becomes ideally suited physically for use in a torchere lamp, as well as many other styles of lighting fixtures and lamps.

Also, by increasing the cross sectional diameter of the innermost tube and by allowing it to be in a plane higher than the plane of the outer tube, it becomes ideally suited physically for use in a downlighted fixture such as a ceiling lamp, table lamp or in a pendant style fixture.

BRIEF DESCRIPTION OF THE DRAWINGS

The present invention is pictorially illustrated in the accompanying drawings that are attached herein.

DETAILED DESCRIPTION OF THE INVENTION

Figure 1:
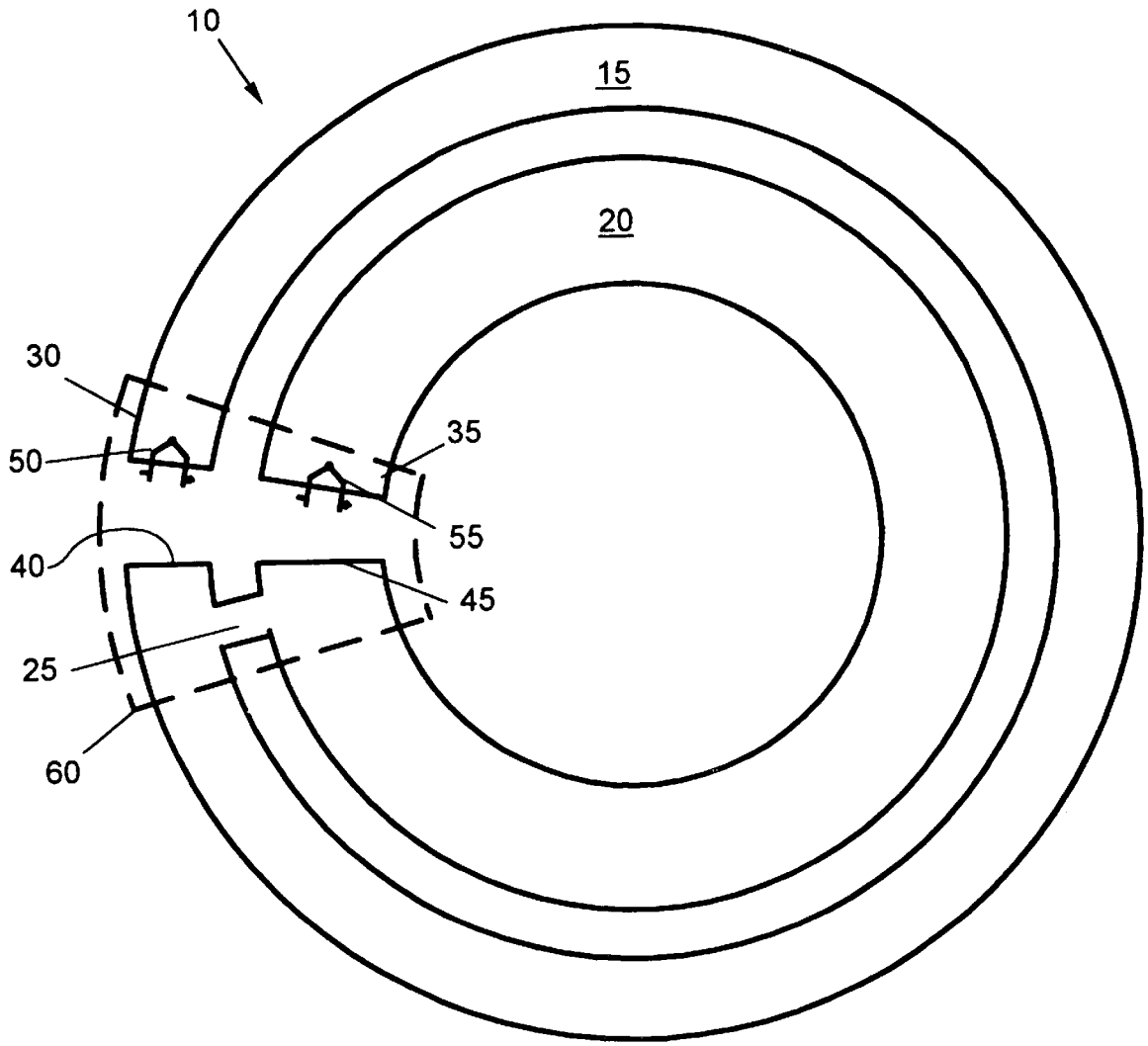
FIG. 1 is a plan view of the novel bridged fluorescent lamp of the present invention.

The present invention relates to an improved circular fluorescent lamp having two or more lamp segments nested in an annular fashion to increase the lumen output. Each annulus is arranged concentrically where each annulus resides in an individual plane that is parallel to previous plane containing another annulus.

Previously, nested circular fluorescent lamps, whether being individual lamps or lamps in a bridged configuration, were arranged coplanar, where each annulus was made from the same glass tubing, each having the same cross sectional area. When arranged in this manner, the circumferential length of the outer annulus is greater than the circumferential length of the innermost annulus, thereby creating a condition where the volume within the outermost tube is greater than the volume within the innermost tube.

When the outer annulus is connected to the inner annulus, using a hollow glass tube to bridge this connection to increase the effective tube length, only two ignition elements are needed, statically; then the internal pressure of each annulus is equalized where there is no pressure gradient across the tubular bridged connection.

Dynamically, however, when the discharge arc exists during typical operation, the temperature of the entrapped gases in each ring increases in a nearly uniform manner. As the temperature of the gases increases, the gases attempt to expand as the temperature rises.

The relationship between the volume of a gas and the pressure was first stated by Robert Boyle in 1662 is as follows: "The volume of a given mass of gas at a constant temperature varies inversely as the pressure."

The gases being in an enclosed volume cannot expand, hence the rise in temperature brings about an increase in the internal pressure. The tubular bridged element connecting the two dissimilar volumes, imposes a high resistance between the two volumes because of its substantially reduced cross sectional area. Hence, the dynamic pressure in the outer tube is greater than the dynamic pressure in the inner tube and is inversely proportional to the enclosed volumes of the tubes, which results in a pressure drop across the tubular bridged element.

When the lamp is turned off and the lamp cools, the entrapped gases, those being at a higher pressure migrate toward the tube having the larger volume. As this cycle is repeated over a period of time, there is less of the mercury vapor in the inner ring, which results in making more difficult to ignite the lamp when starting up; higher ignition voltages being required.

Referring now to the drawings, the preferred embodiment of the fluorescent lamp according to the present invention will be described herein.

FIG. 1 shows the circular dual fluorescent lamp 10 of the present invention. The dual fluorescent lamp 10 is comprised basically of an outer annular fluorescent tube 15 and an inner annular fluorescent tube 20, each connected by a hollow glass tubular bridge element 25.

At one end 30 of the tube 15 is electrode 50 and at the opposite end of the tube 15 is the sealed end 40. The larger diameter tube 20 has at one end 35 electrode 55 and at the opposite end of the tube 20 is the sealed end 45. At the ends 40 and 45, the hollow glass tubular bridge element 25 connects the discharge path of annular tube 15 to the discharge path of annular tube 20.

Support bracket 60 is a wedged shaped bracket of sufficient mechanical strength to support the bridge connected tubes. Any suitable injection moldable insulating plastic type material is suitable.

Figure 2:
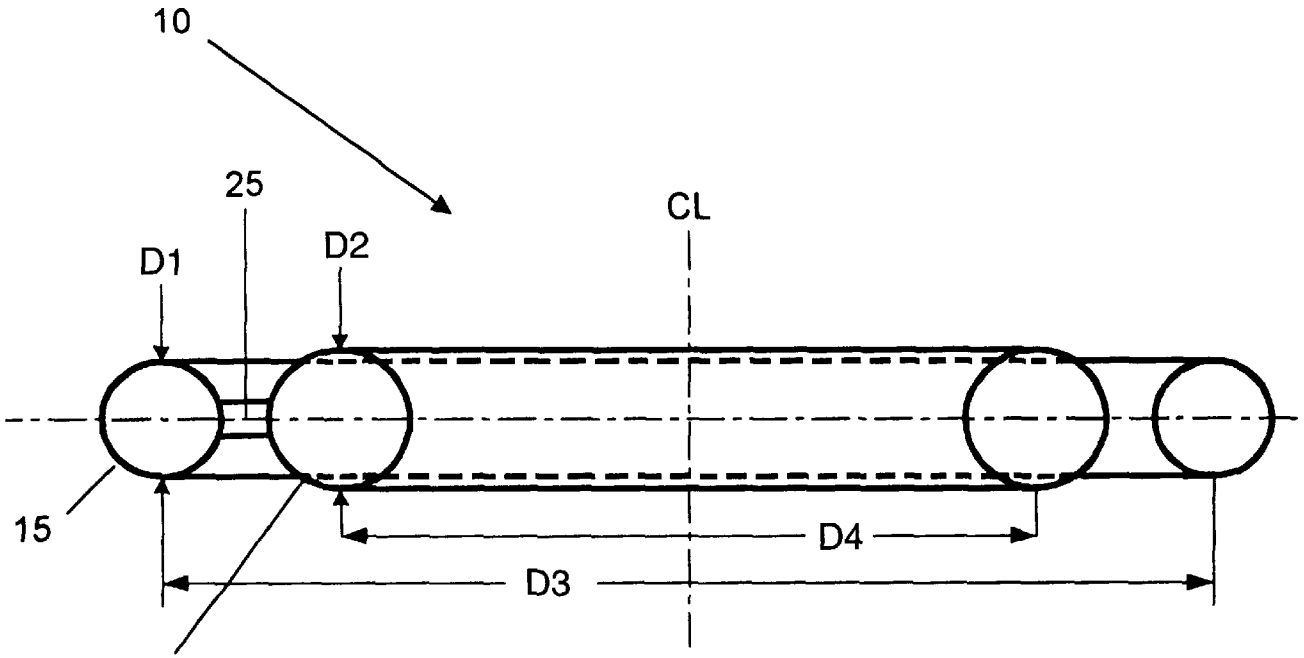
FIG. 2 is a side sectional view of the novel bridged fluorescent lamp, where in this embodiment, the annularly arranged tubes are arranged concentrically coplanar.

FIG. 2 is a side sectional view of a first embodiment where the circular tubes 15 and 20 are concentrically coplanar. The volume within circular tube 15 is adjusted to be equal to the volume within circular tube 20 by selecting tube cross sectional diameters in accordance with the following equations:

$$D_2=D_1\times SQRT(D_3/D_4)$$

Where:

$$V_{15}=V_{20}$$

Figure 2A:
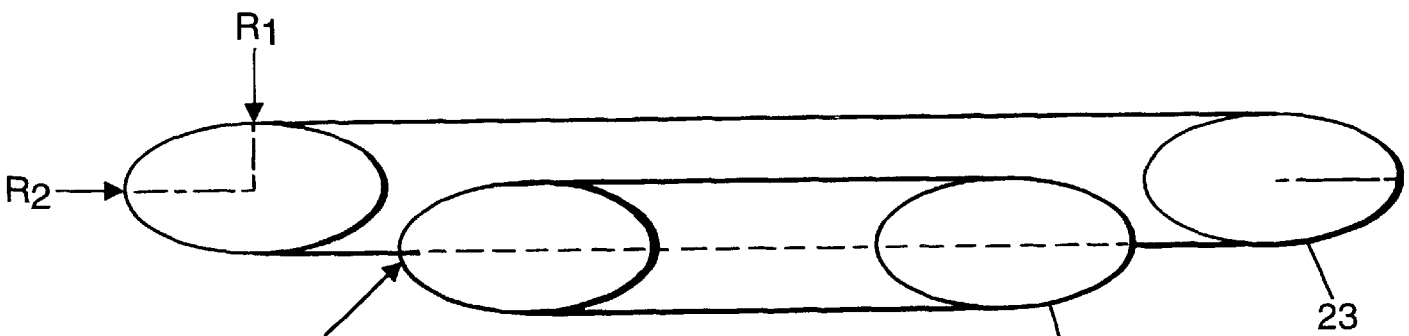
FIG. 2A is side section view of two connected discharge lamps on different planes, where the cross-section of each tube is ovate, the increased area suggesting an increased efficiency.

FIG. 2A is side section view of two connected discharge lamps 22,23 on different planes and the cross-section of each tube is ovate, whereby the increased area to promulgate light provides an increased efficiency. Thus, while the use of the term, diameter, implies a circular cross-section, having a single radial axis, the use of an ovate cross-section, where there are two radii $R_1$, $R_2$ whose axes are displaced from each other, would increase lumen output per energy unit input. The use of an ovate cross-section, where the major diameter $D_1$, is horizontal, would increase the lamps surface area, thereby increasing the illuminating efficiency.

Figure 3:
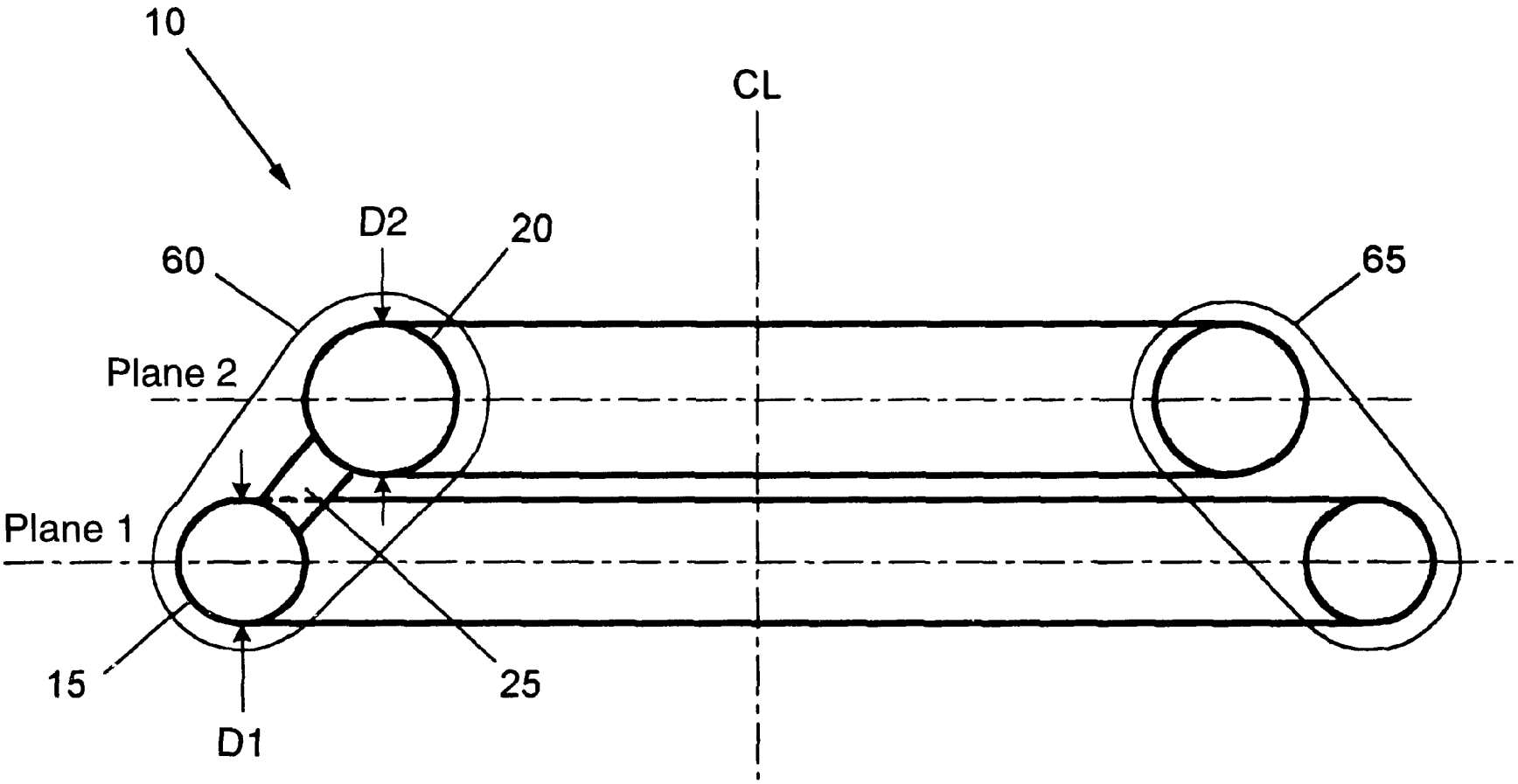
FIG. 3 is a side sectional view of the novel bridged fluorescent lamp, where in this embodiment, the annularly arranged tubes are arranged coaxially in individual planes parallel to each other.

A second preferred embodiment of the present invention is illustrated in FIG. 3, where the circular tubes 15 and 20 are concentrically non-coplanar; the plane 2 in which circular tube 20 lies may be above the plane 1, as illustrated, or by inverting the assembly 10, the circular lamp 20 may lie beneath plane 1.

As shown in this preferred embodiment, the circular tube 20 is in a plane above the plane of circular tube 15. The tubes 15 and 20 are connected by the hollow glass tube element 25 to complete the gaseous discharge path.

By having the volume of circular tube 15 equal to the volume of circular tube 20, there is no migration of the gaseous mixture from one tube to the other as the discharge arc increases the temperature of the gases. The gaseous mixture of an inert gas and mercury vapor remains in equilibrium over a wide temperature range, thereby (1) improving the operational life of the lamp and (2) maintaining a lower ignition voltage of the lamp.

Support bracket 60 encloses and insulates the electrical connections, as well as, to mechanically support tubes 15 and 20, while protecting the tubular discharge connection 25. Oppositely disposed from support bracket 60 is support bracket 65, which mechanically maintains the spatial positioning of tubes 15 and 20 and allows for a flat bracket clip 105 (as shown in FIG. 4) to be used when installing the lamp.

Figure 4:
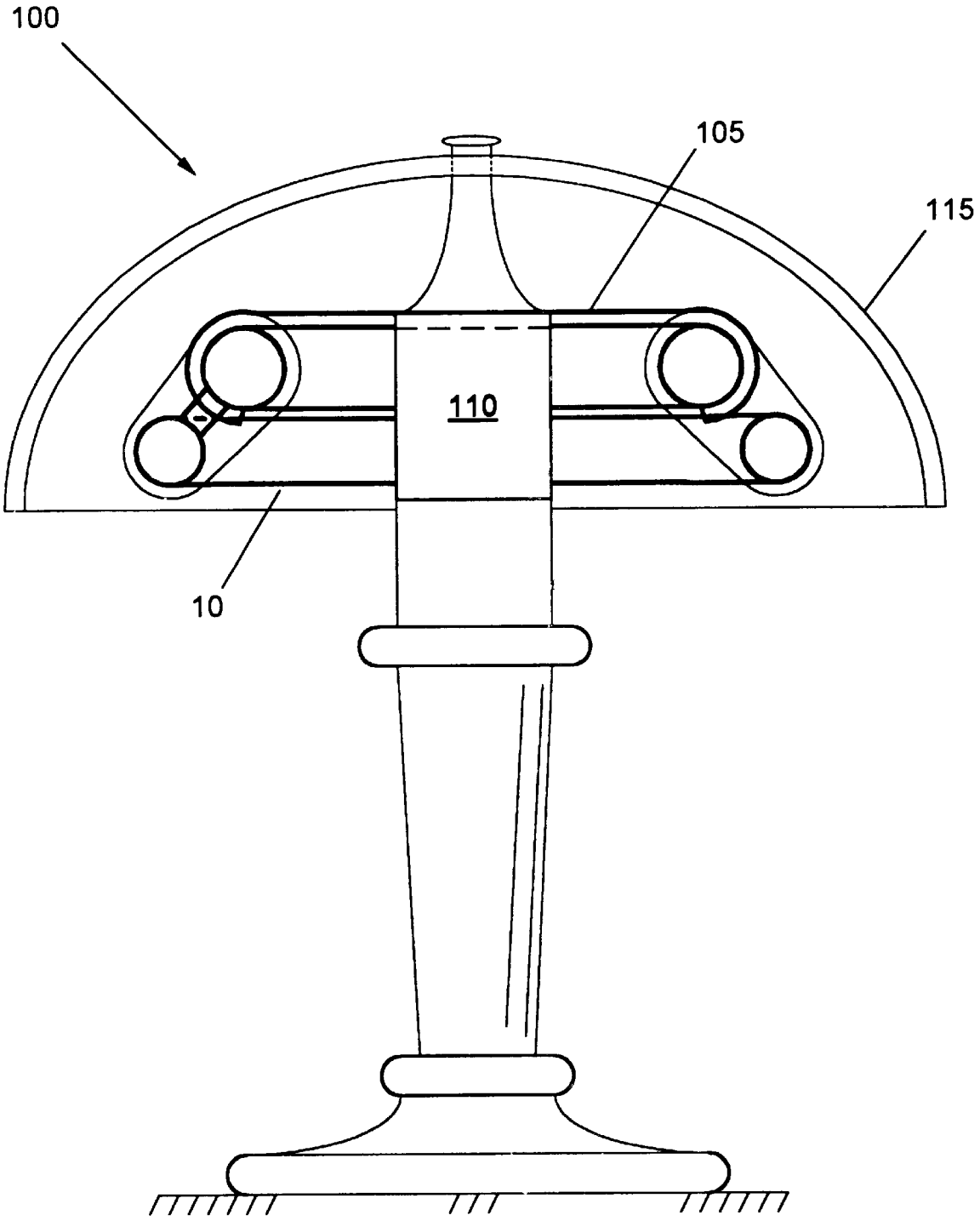
FIG. 4 is a side sectional view of the novel bridged fluorescent lamp, as arranged for use as a desk lamp.

Turning to FIG. 4, there is shown the dual circular lamp 10 of the present invention as used in a desk or table lamp 100. The lamp is retained by a flat plastic member 105 that bridges between support brackets 60 and 65. The plastic bridged member 105 snaps into a channel of the housing of the electronic ballast 110. By having the lamps arranged in conical pyramidal fashion as shown in the present invention, and by using a parabolic shaped lamp shade 115 the illumination is more evenly distributed in a downwardly directed direction.

Figure 5:
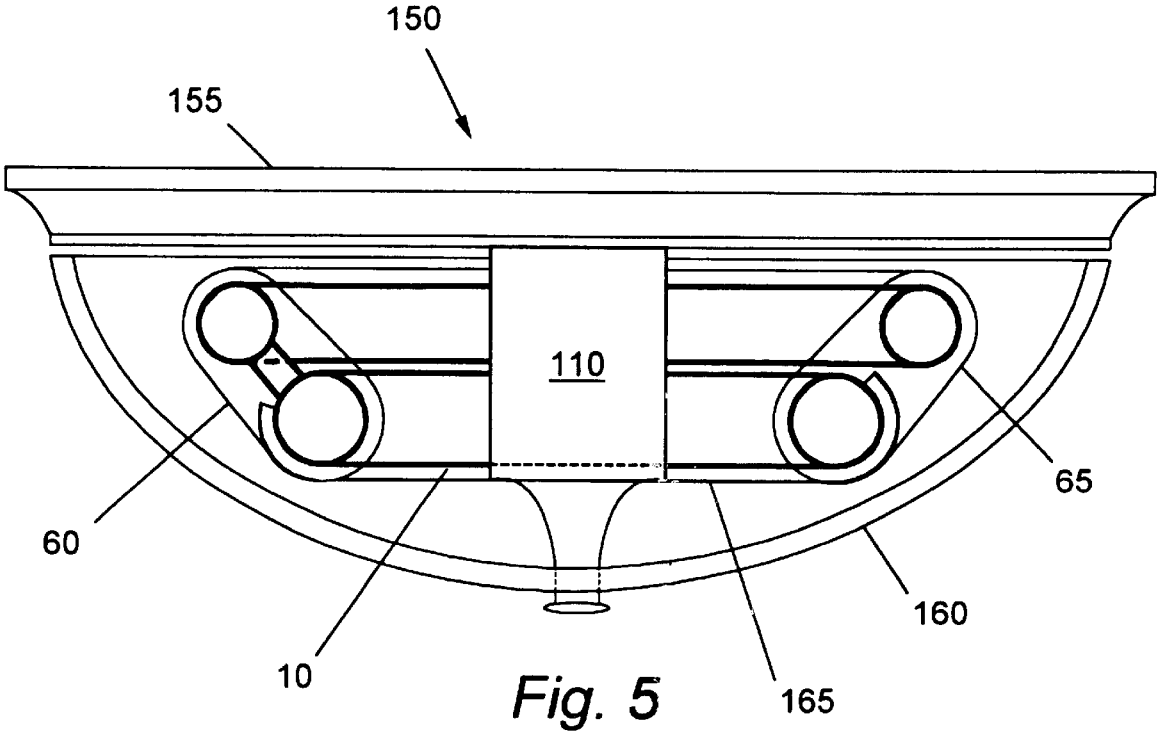
FIG. 5 is a side sectional view of the novel bridged fluorescent lamp in its inverted position, arranged for use in a ceiling mounted fixture.

As shown in FIG. 5, there is shown the dual circular lamp 10 of the present invention as used in a ceiling mounted downlighted fixture 150. Mounted to the fixture base 155 is the electronic ballast 110. The lamp is retained by a short flat plastic member 165 that bridges between the support brackets 60 and 65. The plastic bridged member 165 snaps into a channel of the housing of the electronic ballast 110. By having the lamps arranged in conical pyramidal fashion as shown in the present invention, and by using a protective translucent dome shaped lamp cover 160 the illumination is more evenly distributed.

Figure 6:
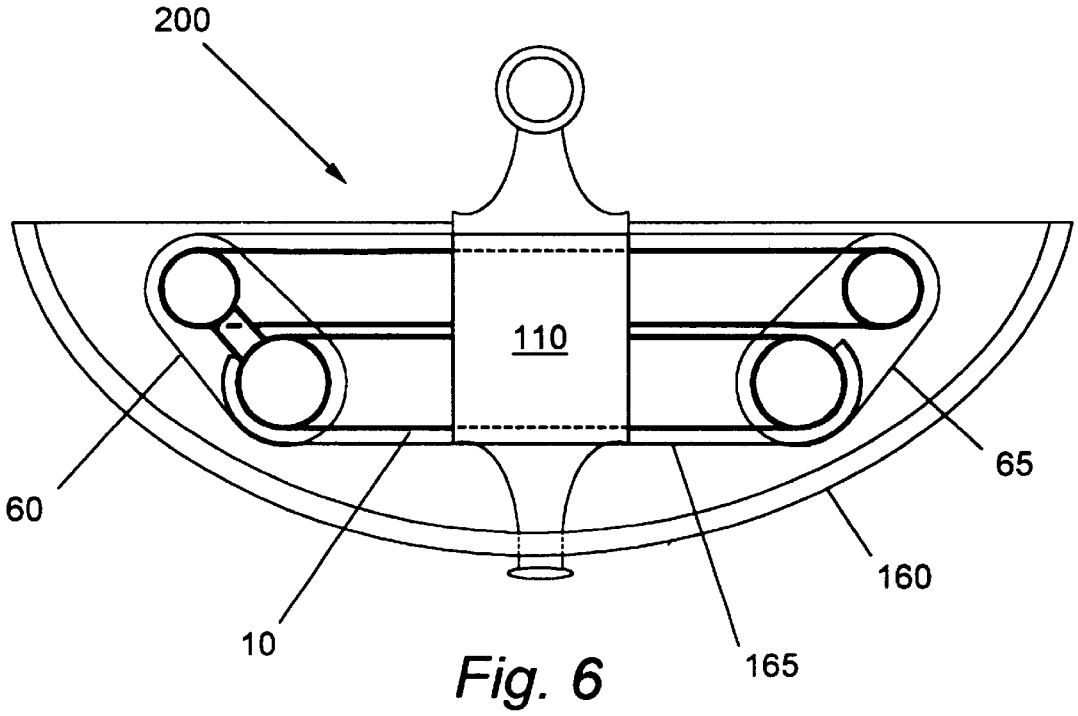
FIG. 6 is a side sectional view of the novel bridged fluorescent lamp in its inverted position, arranged for use as a ceiling mounted pendant fixture.
Figure 7:
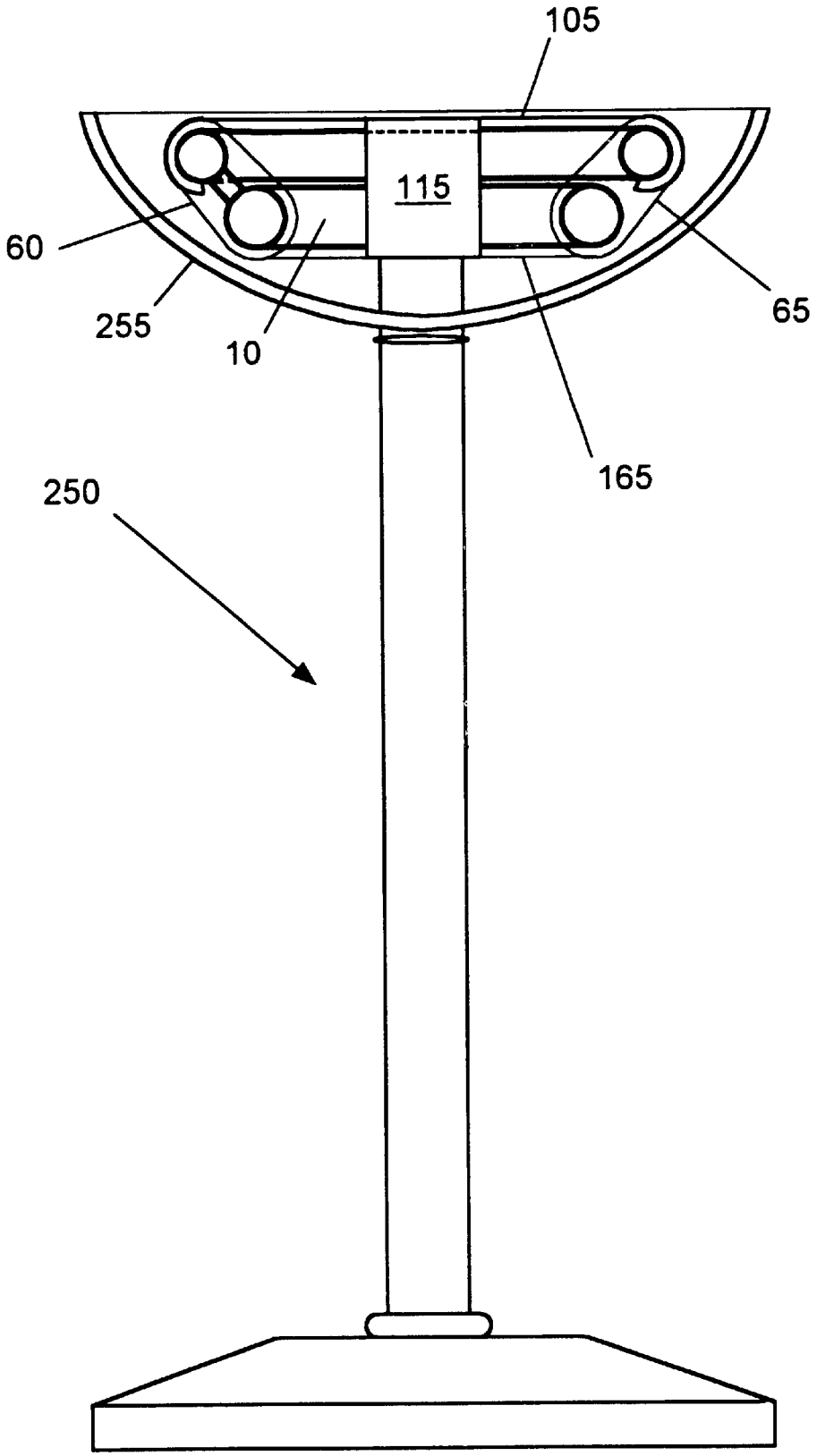
FIG. 7 is a side sectional view of the novel bridged fluorescent lamp in its inverted position, arranged for use in a torchere styled floor lamp.

FIG. 6 illustrates the use of the dual circular lamp 10 in a similar type lighting fixture, a pendant fixture 200 that is suspended from the ceiling by using a decorative chain or the like. The electronic ballast 110 is suspended from the ceiling by a decorative chain (not shown). Mounted in a retention channel in the lower surface of the ballast 110 is a short flat plastic member 165 that connects between support members 60 and 65. The addition of the translucent domed cover 160 not only adds to the decorative features of the fixture but also protects the lamp from inadvertent physical damage.

The dual circular fluorescent lamp 10 of the present invention also finds application when used in an uplighted torchere floor lamp 250. Mounted to the top of the lamp column is the reflector 255 upon which is attached the electronic ballast 115. Bracket 105 snaps into a channel on the top side of the electronic ballast housing. The ends of the bracket bridge between supports 60 and 65 to hold the dual circular lamp in position.

It should be understood that even though the present invention is described in detail for its particular embodiments, there may be other variations and modifications that will become apparent to those who are skilled in the art upon reading this specification, and that these modifications or variations that can be made should not detract from the true spirit of this invention.

What is claimed is:

1. A circular fluorescent lamp, comprising:

a pair of concentric fluorescent tubes connected by a hollow tubular bridge for fluid communication between the tubes to increase a discharge path length and, consequently, a lumen output of the lamp;

the tube pair comprising an outer annular fluorescent tube and an inner annular fluorescent tube;

each tube having an internal diameter, wherein the internal diameter of the inner annular fluorescent tube is larger than the internal diameter of the outer annular fluorescent tube.

2. The circular fluorescent lamp according to claim 1, wherein the internal diameter of each tube is inversely related to a respective tube length.

3. The circular fluorescent lamp of claim 2, each tube having first and second ends with an electrode at the first end and a sealed second end.

4. The circular fluorescent lamp of claim 3, each tube containing a volume of an entrapped gas.

5. The circular fluorescent lamp according to claim 4, wherein the volume of the entrapped gas in said inner annular fluorescent tube is essentially equal to the volume of the entrapped gas in said outer annular fluorescent tube.

6. The circular fluorescent lamp of claim 5, wherein the pair of concentric fluorescent tubes lie in the same plane.

7. The circular fluorescent lamp of claim 5, wherein the pair of concentric fluorescent tubes lie in different planes.

8. The circular fluorescent lamp of claim 7, wherein the plane of said inner annular fluorescent tube is essentially parallel to the plane of said outer annular fluorescent tube.

9. The circular fluorescent lamp according to claim 8, each tube having an internal pressure essentially equal to the other, whereby a pressure gradient across said hollow tubular bridge is essentially zero.

10. The circular fluorescent lamp of claim 9, wherein a starting voltage of the lamp is less than that of a fluorescent circle lamp having a tube pair of unequal volumes due to a gas migration between the tubes of unequal volume.

11. The circular fluorescent lamp of claim 10, wherein a gas migration between the tubes is essentially zero, whereby the circular fluorescent lamp can be started at a voltage of essentially 117 volts AC.

12. The circular fluorescent lamp of claim 11, wherein said essentially equal tube volumes inhibit a performance deterioration to prolong a useful life of the circular fluorescent lamp.

13. A circular fluorescent lamp, comprising:

a plurality of circular annular tubes, wherein each circular tube is in fluid communication with its adjacent tube via a hollow glass tubular bridge;

each tube having an essentially equal volume.

14. The circular fluorescent lamp according to claim 13, each tube lying in the same plane.

15. The circular fluorescent lamp according to claim 13, each tube lying in a different plane.

16. The circular fluorescent lamp according to claim 15, wherein the plane of each tube is essentially parallel to the plane of each other tube.

17. The circular fluorescent lamp of claim 16, said plurality of circular annular tubes comprising a pair of nested tubes with a first outer tube and a second inner tube each tube having an electrode at one end and a seal at an opposite end;

further comprising an at least one support bracket to support the bridge connected tubes and maintain a spatial positioning of the tubes.

18. The circular fluorescent lamp according to claim 17, wherein the volume within each circular tube is adjusted by a selected cross sectional inner diameter of each tube in accordance with an equation, $D_2=D_1\times SQRT(D_3/D_4)$, where $D_2$ is the internal diameter of the second tube, $D_1$ is the internal diameter of the first tube, $D_3$ is a circular diameter of the first tube and $D_4$ is a circular diameter of the second tube, whereby $V_1=V_2$, where $V_1$ is the volume of the first tube and $V_2$ is the volume of the second tube.

19. The circular fluorescent lamp of claim 18, further comprising a flat bracket clip whereby the tubes are concentrically installed in an axial alignment in a lighting fixture.

20. The circular fluorescent lamp of claim 13, wherein a cross section of each tube is ovate, thereby providing an increased surface area and lighting efficiency.

* * * * *